United States Patent [19]

Gubon et al.

[11] Patent Number: 5,003,934

[45] Date of Patent: Apr. 2, 1991

[54] HOOD COVERING THE SPACE BETWEEN CYLINDER BANKS OF AN INTERNAL-COMBUSTION ENGINE WHICH ARE ARRANGED IN A V-SHAPE

[75] Inventors: Peter Gubon, Lindau; Hans Sudmanns; Christoph Teetz, both of Friedrichsafen, all of Fed. Rep. of Germany

[73] Assignee: MTU Friedrichshafen GmbH, Friedrichshafen, Fed. Rep. of Germany

[21] Appl. No.: 490,660

[22] PCT Filed: Jun. 19, 1989

[86] PCT No.: PCT/DE89/00404

§ 371 Date: Mar. 13, 1990

§ 102(e) Date: Mar. 13, 1990

[87] PCT Pub. No.: WO90/00673

PCT Pub. Date: Jan. 25, 1990

[30] Foreign Application Priority Data

Jul. 13, 1988 [DE] Fed. Rep. of Germany ..... 3823685

[51] Int. Cl.[5] ..... F02M 35/10

[52] U.S. Cl. ..... 123/52 MV; 60/323

[58] Field of Search ..... 123/52 MV, 52 MC, 52 M, 123/65 EM; 60/323

[56] References Cited

U.S. PATENT DOCUMENTS

| | | | |
|---|---|---|---|
| 2,801,620 | 8/1957 | Goodridge | 123/52 MV |
| 3,712,064 | 1/1973 | Kuhn | 123/52 MC |
| 4,034,561 | 7/1977 | Sakurai et al. | 60/323 |
| 4,458,491 | 7/1984 | Deutschmann | 60/323 |
| 4,817,566 | 4/1989 | Newman | 123/52 MV |
| 4,836,160 | 6/1989 | Valev | 60/323 |
| 4,932,367 | 6/1990 | Newmar et al. | 123/52 MV |
| 4,951,465 | 8/1990 | Torigai | 60/323 |

FOREIGN PATENT DOCUMENTS

| | | | |
|---|---|---|---|
| 2613426 | 10/1988 | France | 123/52 MV |

*Primary Examiner*—David A. Okonsky

*Attorney, Agent, or Firm*—Barnes & Thornburg

[57] ABSTRACT

A hood covering the space between cylinder banks of an internal-combustion engine which are arranged in a V-shape is provided for the gastight enclosure of a ram pipe arranged in an area between cylinder banks and exhaust pipes leading the fuel gases from the cylinders to the ram pipe. At this type of a hood, sealing surfaces are obtained with respect to the crankcase as well as with respect to the cylinder heads. The hood can be constructed with a central hood part which is fastened to the crankcase and only has contact surfaces with respect to the crankcase, but not with respect to the cylinder heads. Wedge-shaped hood parts, which are constructed in the form of elbows, are arranged in a V-shaped opening between the central hood part and the cylinder heads and are pulled into the V-shaped opening by means of necked-down bolts. Common sealing surfaces exist with the cylinder heads and the central hood part. Positional tolerances are compensated by the fact that the wedge-shaped hood parts take up a corresponding position. For this reason, the forces, by which the sealing surfaces must be presses against one another, are dependent only on the expected thermal warping. The forces introduced into the engine structure are therefore also correspondingly low.

6 Claims, 1 Drawing Sheet

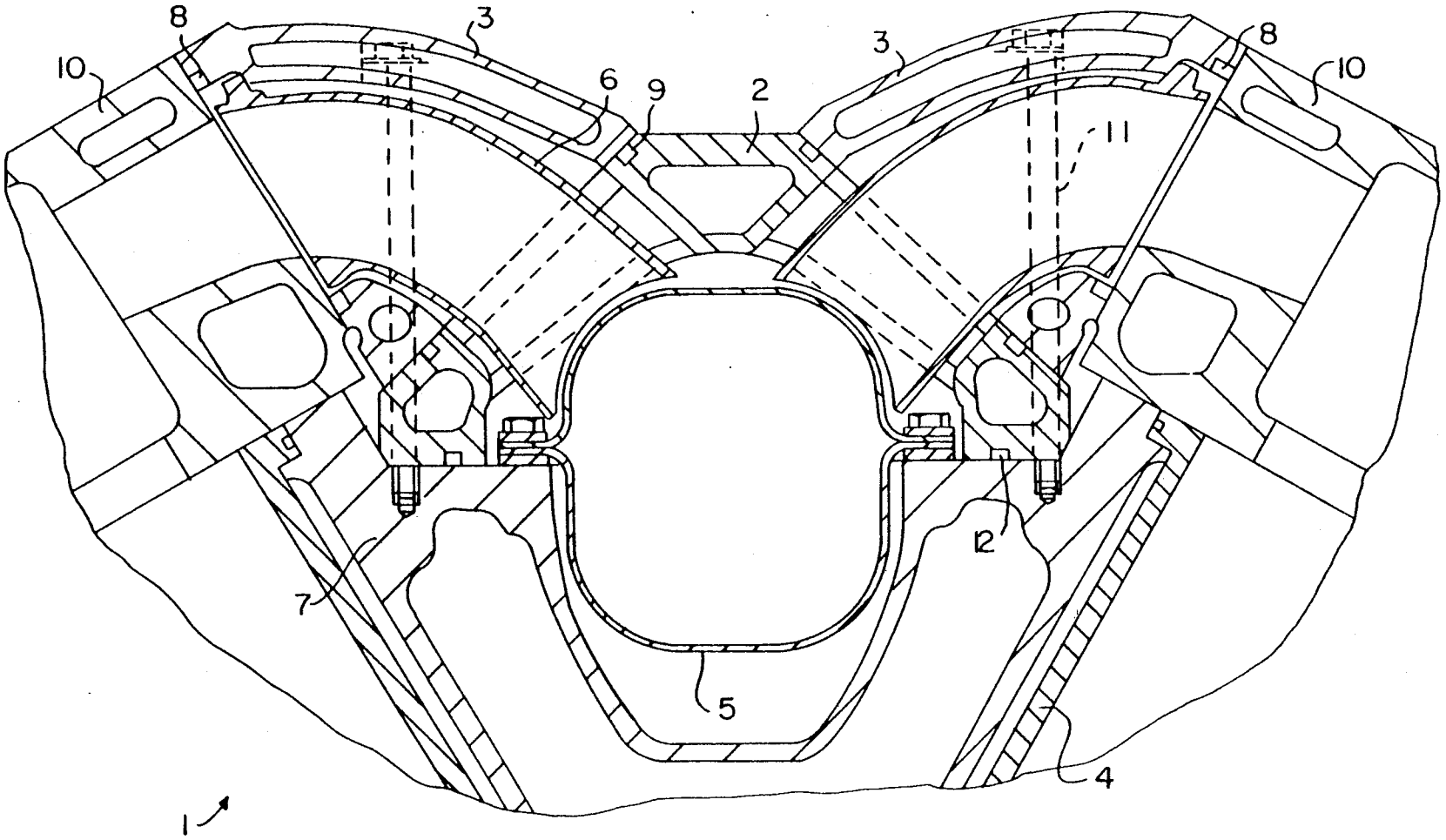
10
8
11
3
2
9
6
3
8
10
4
12
5
7
1

HOOD COVERING THE SPACE BETWEEN CYLINDER BANKS OF AN INTERNAL-COMBUSTION ENGINE WHICH ARE ARRANGED IN A V-SHAPE

BACKGROUND AND SUMMARY OF THE INVENTION

The present invention generally relates to a hood covering the space between cylinder banks of an internal-combustion engine which are arranged in a V-shape.

German Patent Specification (DE-PS) 36 35 478 shows the construction of a housing which, in a gastight manner, encloses a ram pipe of an internal-combustion engine and the exhaust pipes which lead fuel gases from cylinder heads to the ram pipe. The cooled housing is situated in the space between the cylinder banks of the internal-combustion engine which are arranged in a V-shape. The housing comprises a bottom part and a top part, of which the latter has contact surfaces at the cylinder heads as well as at the crankcase.

For the gastight enclosure of the ram pipe and of the exhaust pipes leading to the ram pipe, the contact surfaces at the cylinder heads must be sealed off by the cylinder heads and the top part of the housing (which is not shown), and, in addition, the top part of the housing must be provided with a cover. Further, a tight contact must be provided between the top part of the housing and the bottom part of the housing or, if the exhaust-gas-tight space is delimited by the walls of the crankcase and not by a bottom part of the housing, between the top part of the housing and the crankcase.

Because of the occurring high temperatures, high-temperature resistant graphite seals are required in the sealing areas which, however, have the disadvantage of low ductility. Since the top part of the housing rests on a crankcase and at the same time, forms sealing surfaces with the cylinder heads, and it should be possible to sue high-temperature-resistant seals of only low ductility, if manufacturing tolerances are set that are as narrow as possible in order to achieve positional tolerances that are as low as possible which, however, results in high manufacturing costs.

Because of the unavoidable tolerances and the considerable thermal warping occurring during the operation of the internal-combustion engine, high prestresses must be effective in the area of the sealing surfaces in order to avoid the developing of leaks. However, high prestresses require high screwing forces which are introduced into the crankcase and the cylinder heads and may result in undesirable deformations of the cylinder liners or other parts of the internal-combustion engine.

The present invention is based on an object of ensuring the sealing-off of a space between two cylinder banks of a V-engine which is covered by a hood without special requirements with respect to manufacturing tolerances or without requiring a particularly high ductility of the seals, and without requiring that high forces be introduced into disadvantageous areas of the engine for achieving a good sealing effect.

In a construction of the above-mentioned type, this object and other objects are achieved by constructing the hood with a central hood part which rests only against the crankcase and not against the cylinder heads, and with wedge-shaped hood parts which are inserted into V-shaped openings between the central housing part and the cylinder heads. Thus, the different sealing areas are assigned to separate components which are fastened separately from one another and can be slid with respect to one another. By the separate fastening in connection with the special construction of the hood parts, the contact pressures and thus the sealing effect are independent of the positional tolerances arising as a result of manufacturing tolerances. Therefore, lower prestresses may be provided from the start in the area of the sealing surfaces, whereby the stress of the engine components as a result of forces to be introduced is also lowered.

Other objects, advantages and novel features of the present invention will become apparent from the following detailed description of the invention when considered in conjunction with the accompanying drawings.

BRIEF DESCRIPTION OF THE DRAWING

The sole FIGURE of the present invention is a cross-sectional view of an internal-combustion engine in the area of the ram pipe in accordance with one embodiment of the invention.

DETAILED DESCRIPTION OF THE DRAWING

In the internal-combustion engine 1 shown in cross-sectional view in the figure and having cylinder banks arranged in a V-shape, a ram pipe 5 as well as exhaust pipes 6 leading the fuel gases from the cylinders 4 to the ram pipe 4 are arranged in an exhaust-gas-tight space in an area between the cylinder banks. The exhaust-gas-tight space is formed by corresponding walls of a crankcase 7 and a hood covering the crankcase 7. The hood covering the space is formed by a central hood part 2, which rests on the crankcase 7, and wedge-shaped hood parts 3 which are constructed as elbows and connect the cylinder heads 10 with the central hood part 2. The end faces of the hood parts 3 rest sealingly against the central hood part 2 and against the cylinder heads 10. In the contact surfaces, respective annular seals 8, 9 are arranged for the compensation of shape tolerances. One of the annular seals may not be necessary in this case. The hood parts 3 are screwed to the crankcase 7 by two screws 11 respectively, such as necked-down bolts, which have a high ductility.

As a result of their wedge-shaped construction and their slideability with respect to the central hood part 2, the hood parts 3 can compensate positional tolerances and thermal warping by changing their vertical positional tolerances and thermal warping by changing their vertical position. The sealing effect is independent of the positional tolerances. The forces, which press the sealing surfaces of the wedge-shaped hood parts 3 during their contact against the central hood part 2 and against the cylinder heads 10, therefore, depend only on the expected thermal warping of the internal-combustion engine and not on positional tolerances. The forces introduced by the screws 11 into the engine structure are correspondingly low. Since the thermal warping of the engine is absorbed by the screws 11 by shifting the wedge-shaped hood parts 3, sealing elements may be used with low ductility, such as graphite seals, which are resistant to high temperatures.

The compensation of shape tolerances at the central hood part 2 may take place by a seal 12 in contact with the crankcase 7. Positional tolerances have no effect on the sealing. The hood parts 3 resting on the central hood part 2 also increase the contact pressure of the hood part 2 onto the crankcase 7. As a result, the sealing effect is increased between the crankcase 7 and the hood part 2. The force exercised by the hood parts 3 at the central hood part 2 can be taken into account when planning the number of fastening screws for the central hood part 1.

It is also an advantage that, because of the fastening of the hood parts 3 by means of bolts 11 in the crankcase 7, only transverse forces are introduced into the cylinder heads. Since the contact pressure are kept within certain limits and are introduced in a manner in which they are distributed over the contact surfaces, the risk of an undesirable deformation, particularly in the area of the liners, is excluded.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A hood covering a space between cylinder banks of an internal combustion engine arranged in a V-shape for providing a hermetically sealed enclosure for a ram pipe arranged in an area between the cylinder banks and for exhaust pipes leading fuel gases from cylinders of the cylinder banks to the ram pipe, the internal combustion engine having a crankcase and a cylinder head at each cylinder bank, the head comprising:

contacting surfaces at the crankcase and at each of the cylinder heads;

a central hood part which rests on the crankcase and forms a V-shaped opening between the central hood part and each of the cylinder heads;

outer hood parts which are wedged into each of the V-shaped openings between the central hood part and cylinder heads, to hermetically seal the V-shaped openings; and fastening means for pulling each of the outer hood parts into an associated V-shaped opening.

2. A hood according to claim 1, wherein each of the contact surfaces include a hermetic seal.

3. A hood according to claim 1, wherein the fastening means comprises at least one bolt for each outer hood part, the at least one bolt having a high ductility.

4. A hood according to claim 1, wherein each of the outer hood parts have a wedge-shaped cross-section.

5. A hood according to claim 4, wherein each of the outer hood parts are fastened to the crankcase by the fastening means.

6. A hood according to claim 1, wherein each of the outer hood parts are elbow shaped and each have an end adjacent an associate cylinder head which is shaped in the form of a wedge.

* * * * *